US005915990A

United States Patent [19]

Beer et al.

[11] Patent Number: 5,915,990

[45] Date of Patent: Jun. 29, 1999

[54] PLUG-IN ELECTRICAL CONNECTOR INCLUDING SLIDE CONDUCTOR FASTENER MEANS

[75] Inventors: Dieter Beer, deceased, late of Hoesbach-Feldkahl, by Monika Ilse Beer, nee Vetter, legal representative; by Edgar Beer, legal representative; by Irmgard Beer, legal representative, both of Fürth; Kurt Hermanns, Gross-Umstadt; Reinhard Ruhm, Pfungstadt; Solveig Lux, Schaafheim-Mosbach, all of Germany

[73] Assignee: Weidmueller Interface GmbH & Co., Detmold, Germany

[21] Appl. No.: 08/889,936

[22] Filed: Jul. 10, 1997

[30] Foreign Application Priority Data

Jul. 12, 1996 [DE] Germany ..... 19628116

[51] Int. Cl.[6] ..... H01R 4/24

[52] U.S. Cl. ..... 439/417; 439/404

[58] Field of Search ..... 439/417, 404, 439/598, 701, 686

[56] References Cited

U.S. PATENT DOCUMENTS 4,066,316 1/1978 Rollings ..... 439/91
4,143,935 3/1979 Goodman et al. ..... 439/405
4,938,711 7/1990 Davis et al. ..... 439/405

FOREIGN PATENT DOCUMENTS

OS 2545791 5/1976 Germany .
2835316C2 2/1979 Germany .
1293970 10/1972 United Kingdom .

*Primary Examiner*—Steven L. Stephan
*Assistant Examiner*—Jean Duverne
*Attorney, Agent, or Firm*—Laubscher & Laubscher

[57] ABSTRACT

A connector for connecting at least one first conductor 5 with another conductor 50, including a connector body 2 having a first end containing a chamber 2*a*, and a second end containing a through bore 2*b* communicating with the chamber, a slide member 4 slidably mounted in the connector body chamber, the slide member containing a transverse bore 25 for receiving the first conductor, the slide member including at its end within the chamber a longitudinally projecting pin portion 18, and an electrical terminal 3 slidably mounted on the slide member pin portion, the slide member being slidably displaceable relative to the electrical contact from a first position in which a contact portion 9 of the terminal is remote from the transverse bore to permit the insertion of the first conductor therein, to a second position in which the contact portion extends across the transverse bore in electrical engagement with the first conductor, the free extremity of the contact being received by a corresponding opposed recess formed in the wall of the transverse bore.

16 Claims, 5 Drawing Sheets

PLUG-IN ELECTRICAL CONNECTOR INCLUDING SLIDE CONDUCTOR FASTENER MEANS

SPECIFICATION

BACKGROUND OF THE INVENTION

1. Field of the Invention

This invention relates to a plug-in electrical connector for electrically connecting one or more insulated first conductors to corresponding second conductors, use being made of electrical terminals carried by slide members slidably connected with the connector body. The slide member is slidably displaceable from a first position relative to the connector in which the conductor may be inserted in a transverse bore contained in the slide member, to a second position at which self-tapping cutting contacts at one end of the electrical terminal server the insulation and electrically engage the center conductor. At the other end, the electrical terminal includes female plug-in contacts for connection with the associated second conductor.

2. Brief Description of the Prior Art

One problem that is frequently encountered in connecting electrical connectors is that which occurs when a large number of different first conductors, for example, from a cable tree or the like, are to be connected with suitable plug-in connectors associated with a corresponding subassembly.

Along with conventional soldering and screw techniques, it is been proposed to provide ribbon cables as well as so-called insulation displacement connections, by means of which one can electrically contact and mechanically fasten a large number of single conductors of a ribbon cable simultaneously with a correspondingly equipped plug-in connector.

Such a specific plug-in connector is shown in the German patent No. DE-28 35 316 C2, wherein a plug-in connector is used with a multi-wire ribbon cable having a basic plug-in connector that protrudes therefrom with a cover and with a locking device that has parallel supports protruding away from the cover with stops and a locking clip at the end of the basic part, each of which has two arms that extend upwardly from the basic part that are connected with each other by a cross piece, while the locking device facilitates a preassembled position in a locked position of the cover with respect to the basic part. In the cover, there is provided a slip for the reception of the ribbon cable along with openings for the reception of the conductors, while the ends of the connectors in the preassembled position are enclosed by the openings and when in the locked position protrude through the slip. Thus, the idea is to ensure that the connectors will not be bent or damaged prior to assembly with the ribbon cable. Furthermore, on each support, there are provided a pair of stops that are spaced apart and which, in the preassembled position, receive the cross piece between themselves, while when, in the locked position, they are underneath the cross piece. Furthermore, the slip for reception of the ribbon cable has opposite surfaces with notch-like detents.

The disadvantage inherent in such a connector for ribbon cables is that the guide and locking of the cover with relation to the basic housing takes place exclusively in the front areas of the plug-in connector, because the interior area cannot be provided with guide elements owing to the space required for insertion thereof. Consequently, the guide as well as the locking of the plug in the plug-in connector is extremely difficult, and because of the small dimensions of the guide devices owing to the space problems, reliable guidance of the cover is not provided. More particularly, the guide and locking elements of the cover can break off or otherwise be damaged, whereby reliable assembly is no longer guaranteed with the help of guides nor can the cover be fixed in position on the basic housing.

In the published German application No. DE OS 25 45 791, a connection piece for ribbon cables is disclosed wherein a contact housing includes a plurality of parallel guide channels and inside each guide channel there is provided a contact element with penetration contacts that can be displaced from a first locking position—in which the penetration contacts are outside the lateral slit within which the conductor is introduced—toward a second locking position in which the penetration contacts extend into the lateral slit for the purpose of electrically engaging the cable conductors.

The disadvantage inherent in this arrangement, which permits reliable guidance of the contact elements, results from the fact that the contacting elements are directly subjected to relatively high joining forces, so that there is some uncertainty as to the manner in which the contact elements can be shifted, particularly because of the anticipated sliding guidance within the channel owing to unavoidable tolerances.

A plug-in connector is furthermore known from the British patent No. 1,293,970 wherein a contacting element provided with a cutting edge is arranged in a slide member so that it can be displaced within the guide channel of a housing. The contact elements of the cutting connection are so arranged that they protrude inside the housing against damage, but securing the slide inside the guide channel and its mobility are uncertain owing to the unavoidable tolerances produced in the sliding guide means.

The present invention was developed to avoid the above and other drawbacks of the known multi-pole connectors.

SUMMARY OF THE INVENTION

Accordingly, a primary object of the present invention is to provide an electrical connector including a plurality of slide members that are interchangeable and are each associated with first conductors of given sizes, respectively, thereby to provide a high degree of flexibility when it comes to connecting the conductors with a plug-in connector.

According to another object of the invention, owing to the guidance of the electrical terminal on a pin-like guide element, it is possible to preassemble the slide member and the electric terminal prior to connection with the connector body, thereby providing a subassembly that can be handled independently, whereby one can assure that there is no loss between the terminal and the slide member by suitable configuring and securing of the components.

Here, it is particularly advantageous that the connector body and the slide member can be positioned in a position in which the transverse bore is unobstructed for receiving the individual first conductors so that during preassemble of the subassembly of the connector and slide member, the opening that receives the first conductor will not be inadvertently blocked by the terminal, which would then make it impossible to insert the individual conductor.

In accordance with another advantage of the invention, the transverse bore or channel that receives that individual conductor is arranged normal to the axis of travel of the slide member. This means that during the joining movement between the slide member and the connector body a pin-like guide projection on the sliding member is used to retain the electric terminal thereon, whereby during assembly of the components, the insulation of the individual conductor may be penetrated by the cutting edge of the terminal so that proper electrical contact may be ensured with the inner conductor of the insulated conductor.

According to another advantageous embodiment of the invention, the preassembled components of the slide and the electrical terminal can be simultaneously introduced into the cavities of the connector body. In this way, the connection subassemblies consisting of the slide and the terminal are securely received in the connector body, such that various connection subassemblies may be provided in the multi-pole plug-in connector. In this way, one can ensure both the retention of the connection subassembly and the insulation of the individual conductors that are connected with the subassembly.

In another preferred embodiment, the slide member includes at least one catch element that cooperates with a corresponding catch member on the housing, thereby to lock the slide member in a given position relative to the connector body. Along with secure retention of the subassembly consisting of the slide, terminal and also possibly the individual conductor, one can thus further ensure that the connection will not come loose after insertion within the housing. This reliably prevents unintentional separation of the slide member from the connector body, and permits use of the connector in unfavorable environments subject to unavoidable mechanical vibrations.

A preferred embodiment of the single-pole or multi-pole plug-in connector according to the invention occurs includes a preassembled subassembly consisting of the slide member and the terminal prior to connection with the individual conductor can be together in a separable manner with the housing in a preliminary catch position. For this purpose, the electric terminal is preassembled with the slide member by mounting it on a pin-like guide element protruding from the slide member, and this preassembled component is introduced into the chamber of the connector body. Here, it must be noted that both the preassembled subassembly consisting of the slide member and the terminal is so positioned that the individual conductor can be introduced into the channel-like or transverse bore opening, whereas the joining movement between the slide member and the connector body can also be performed within the housing.

This can be accomplished in that the slide member with the conductor arranged thereon is introduced into the chamber of the conductor body initially only so far as to a first position determined by a first catch connection. This preliminary catch position is so determined that the shifting of the slide member resulting from the joining movement with the individual conductor relative to the connector body, can be accomplished without impairment by the provision of stop abutments on the walls of the interior of the plug-in connector.

According to another advantageous embodiment the preassembled subassembly consisting of the slide member and the connector can be shifted from the preliminary catch position into a final catch position during which the cutting contacts on the electric terminal cut through the insulation of the individual conductor to engage the conductor within the insulation, which connection occurs simultaneously with the introduction of the slide member within the connector to the final catch position. Thus, only one assembly movement is needed in order to connect the individual conductor with the connection subassembly and the subassembly within the housing. When performing the joining movement between the slide member and the connector body, it is advantageous to provide abutments within the chamber of the connector body to prevent incorrect insertion of the preassembled subassembly within the housing. At the same time, by fixing the electric terminal on the interior of the housing, one can make sure that the joining forces on the terminal that occur during the joining, movement of the slide member and the connector body are deflected into the housing so that the terminal will be reliably supported. In this way, there can be no stress overload that can lead to undesirable deformation of the electric terminal which results in accurate contact with the insulated conductor, or no contact at all.

A further advantageous embodiment of the invention includes stop shoulders within the connector body which act with corresponding stop surfaces on the slide member, thereby limiting the extent of relative movement of the components.

According, to a further advantageous feature, the slide member has a well-defined actuation zone for receiving an operating tool by means of which the slide member is displaced. For example, for the individual subassembly of the components, a depression is provided in the slide member for receiving the tip of a screwdriver of the like which displaces the slide member from its first catch position to its second catch position.

According to another feature of the invention, the preassembled subassembly consisting of the slide member and the conductor is achieved outside the chamber of the connector body, and the electric terminal is mounted on a pin-like projection on the slide member, thereby protecting the electric terminal against deleterious forces during assembly of the slide member and the connector body. The preassembled subassembly consisting of the slide member and the connector is effected by means of separate tools, such as a plier-like tool, which mount the electric terminal on the pin-like projection prior to insertion of the slide member within the cavity contained in the connector body. The tools that effect the joinder between the components include functional surfaces that are correspond with the shape of the terminal and the slide member, thereby permitting reliable support and absorption of the forces during joining.

According to another feature of the invention, the preassembled subassembly consisting of the slide member and the conductor as well as the terminal will be effected prior to assembly with the connector body. In this way, it is possible, for example, to insert prefabricated connection subassemblies attached to individual conductors into the common multi-pole housing, thereby to simplify the manufacture of the connectors.

In accordance with another feature of the invention, the subassembly consisting of the slide member, the terminal and an individual conductor are inserted directly into the housing toward a terminal catch position. This final catch position can be such that the slide member is secured in place and the conductor is locked in position. The slide member may be disconnected from the connector body by operation of release means that disengage the catch from the final catch position.

According to another feature of the invention, the various subassemblies can be color coded for interchangability of parts relative to a common multi-pole connector body, thereby avoiding the need for any extensive external markings. It is furthermore possible to have the connection groups of conductors and terminals of different dimensions depending on the cross section of the individual conductor that is to be connected to a corresponding conductor. In the process, the dimensions of the slide member and the terminal are coordinated with the diameters of the individual conductors, thereby preventing the association of conductors of improper size with corresponding terminals and slide members, as avoided by the use of different color markings.

Moreover, it is possible to assure that different color-coded connections and terminals whose dimensions differ can be inserted in a common multi-pole housing for various subassembly connections. This is particularly advantageous for the prefabrication of cable trees, because of the different electric properties for desired resistance values of the conductors having different cross sections are often combined in a single multi-pole plug-in connector. Moreover, a plug-in connector can be provided with components of the subassemblies that can be inserted in only certain chambers of the housing. This is particularly advantageous when standardized plug-in connectors must be provided, depending on the actual individual case, with single conductors instead of a full-parts placement only in certain plug-in places, whereby in addition to subsequent retrofitting of the plug-in connector with additional single connectors is also possible.

In the event that no slide member is to be inserted within any of the chambers contained in the multi-plug connector body, color-coded dummy plugs may be inserted in to the empty chambers.

According to another feature of the invention, the insulated first conductors can be arranged at various angles relative to the longitudinal axis of the connector body. To this end, the position of the individual conductor is determined adjacent the region at which it exits from the plug-in connector body, for example, by suitable housing contours. It is also possible to provide a certain angle area in which the single conductor can be swung, preferably oriented between about 90° and 180° relative to the axis of the transverse bore contained in the slide member. To this end, the individual conductors may be arranged in a desired manner relative to the multi-pole connector body. Furthermore to lock the individual conductors to the connector body, locking shoulders may be provided which clamp the individual conductor to the connector body and to the slide member. Thus, a defined passage may be provided for guiding the individual conductor as it exits the connector body. This brings about the clamping of the insulation of the individual conductor between the housing and the slide member for example by means of assembly. Shaping the clamping gap in coordination with the dimensions of the insulation of the individual conductors, one can ensure reliable locking forces that reliably prevent unintentional withdrawal of the individual conductor from the subassembly in addition to the forces on account of the connection between the cutting edge of the terminal and the insulation and the conductor.

In accordance with another feature of the invention, the connector body is provided with a hook-like projection for connecting the connector body to like connector bodies or to associated equipment. Dual means may be provided for permanently connecting the electric terminal with the slide member. A magazine containing a plurality of preassemble subassemblies may be used for supplying the subassemblies prior to insertion within the chamber of the connector body. The magazine can have the shape of a spool on which the subassemblies are supplied to the action zone for connection with the component. The assembly of the components can be manual, semi-automatic or automatic depending on the type of assembly and the housing.

BRIEF DESCRIPTION OF THE DRAWINGS

Other objects and advantages of the invention will become apparent from a study of the following specification, when viewed in the light of the accompanying drawings, in which.

DETAILED DESCRIPTION

Figure 1:
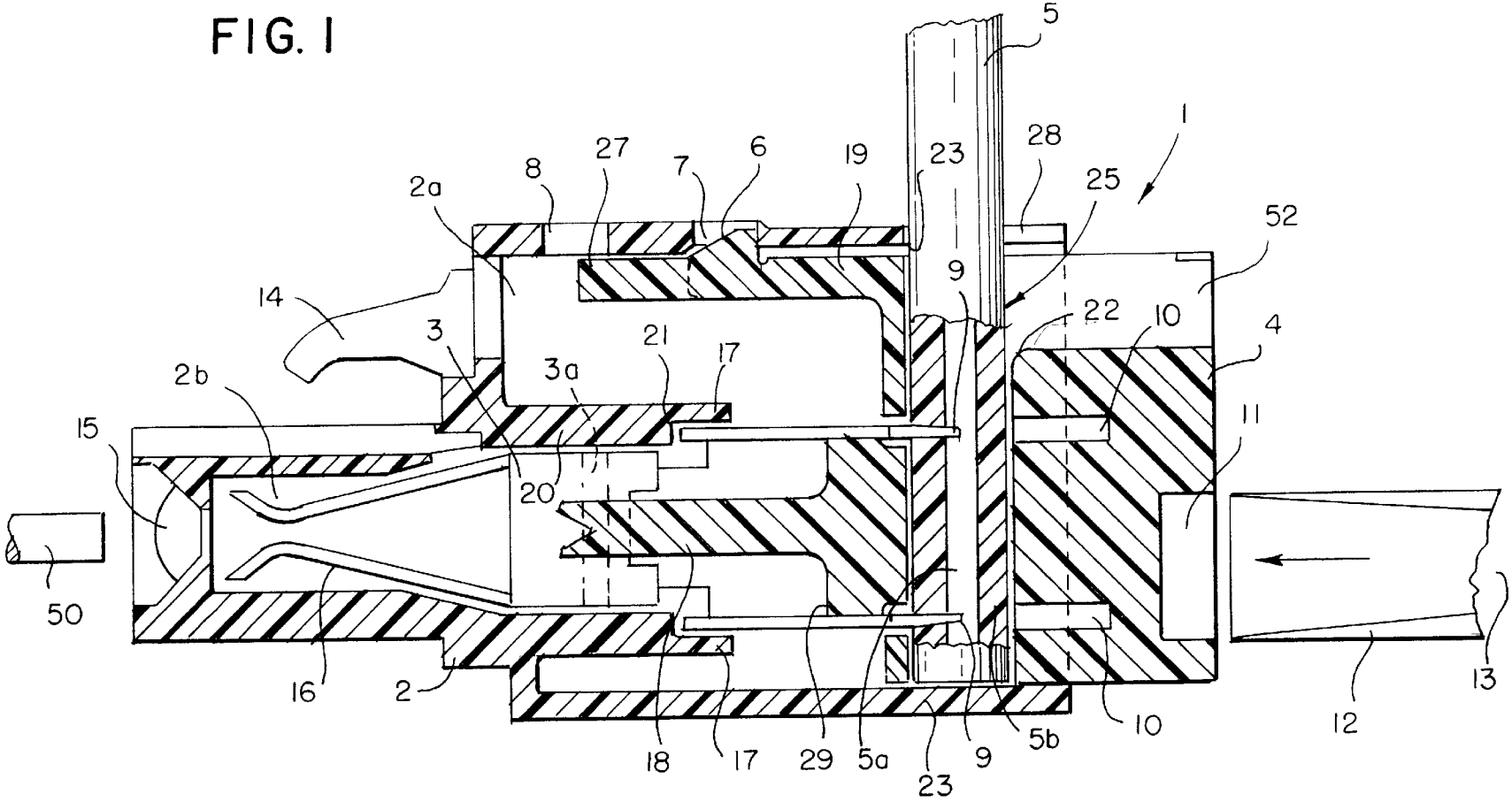
FIG. 1 is a longitudinal sectional view of the electrical connector of the present invention when in an initial first catch portion.
Figure 6:
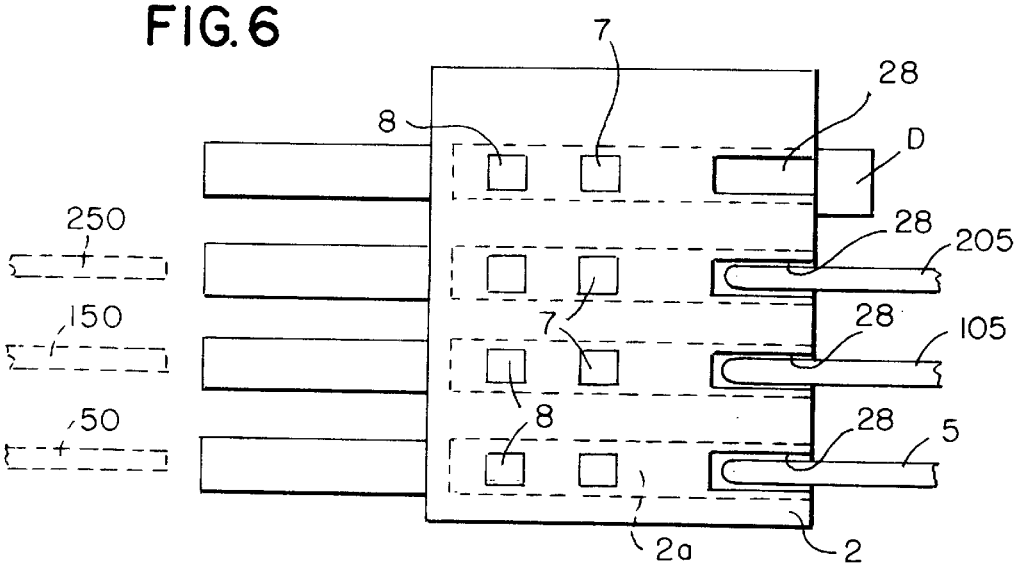
FIG. 6 is a somewhat diagrammatic top plan view of the electrical connector of FIGS. 1 and 2.

Referring first more particularly to FIG. 1, the multi-pole connector 1 includes a connector body 2 containing at one end a chamber 2*a* that slidably receives a slide member 4 which carries the electrical terminal 3 for connecting a first conductor 5 with a second conductor 50. As shown in FIG. 6, the multi-pole connector 2 includes a plurality of cavities 2*a*, 102*a*, 202*a*, 302*a* arranged in rows for connecting the conductors 5, 105, and 205 with the second conductors 50, 150, and 250, respectively. A dummy plug D is provided in the cavity 302*a*, as will be described below.

Referring more particularly to FIG. 1, the cavity 2*a* provided at one end of the connector body 2 slidably receives the slide member 4. At its other end, the connector body 2 contains a longitudinal through bore 2*b* that contains the electrical terminal 3. The slide member 4 contains a transverse bore 25 for receiving the first conductor 5 that extends transversely across the longitudinal slot 28 contained in the first end of the connector body 2. The central portion of the electrical terminal 3 includes guide means 3*a* that slidably receive the guide pin 18 that extends longitudinally from the slide member 4. At one end, the electrical terminal 3 includes longitudinally extending the contacts 9 having cutting edges that extend into the transverse bore 25 via corresponding openings contained in the slide member 4. At its other end, the electrical terminal 3 includes female plug-in contacts 16 that are adapted to receive the second conductor 50 which is inserted via the cable insertion opening 15 of the longitudinally extending through bore 2*b* of the connector body 2. The slide member 4 is retained in the illustrated first catch position of FIG. 1 by means of the detent or catch projection 6 that extends within the corresponding first catch opening 7 contained in the upper wall of the connector body 2. The through bore 2*b* is provided with stop shoulder surfaces 21 that are engaged by the contacts 9 of the electrical terminal 3, thereby limiting the displacement of the electrical terminal 3 to the left relative to the connector body member 2. At its right end, the slide member 4 contains an actuating recess 11 for receiving the tip of an actuating screw driver 12, which is operable to displace the slide member 4 to the left as shown by the arrow 13 toward the second catch position illustrated in FIG. 2.

Figure 2:
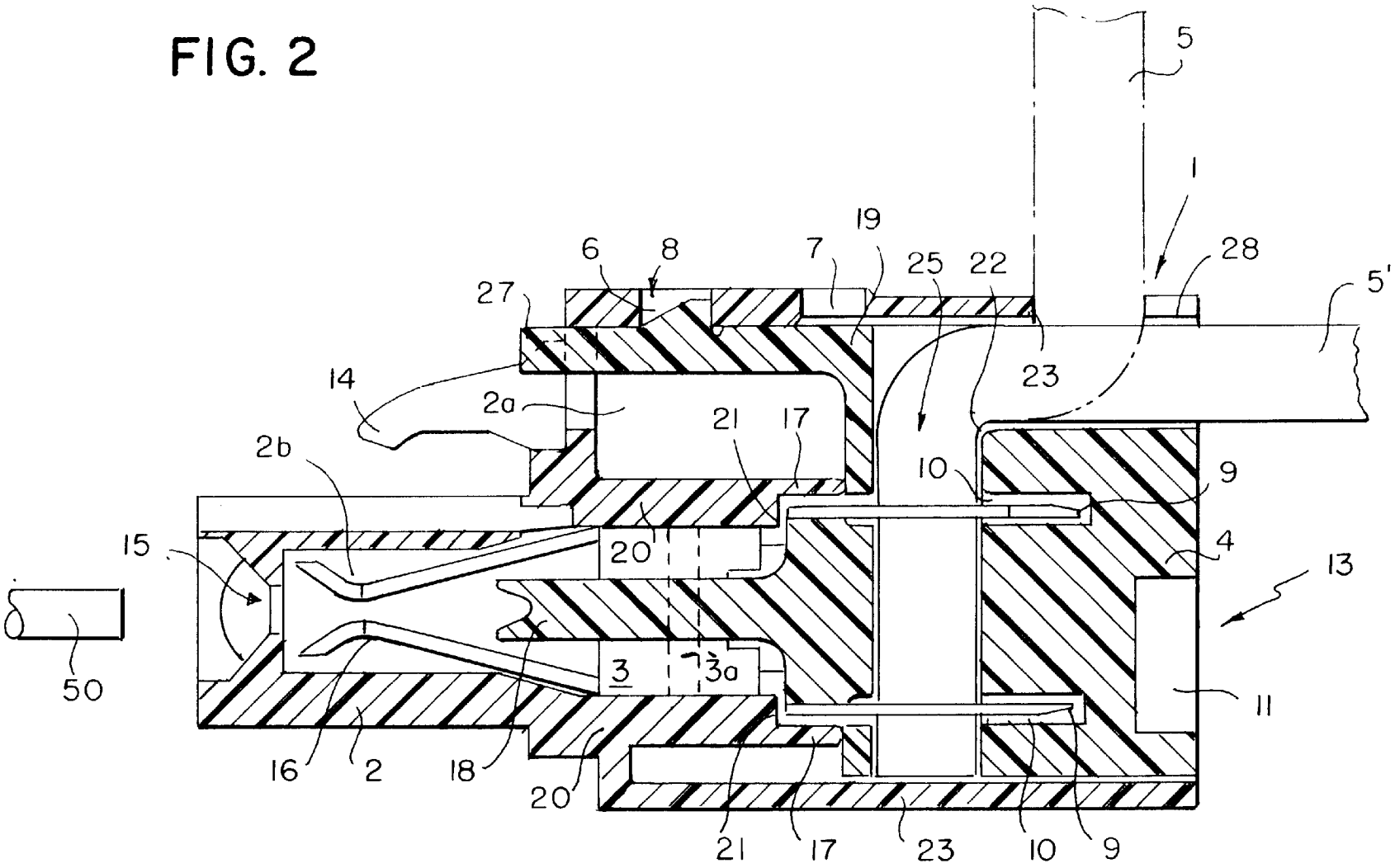
FIG. 2 is a longitudinal sectional view of the electrical connection of FIG. 1 when in the final second catch portion.

Referring to FIG. 2, it will be seen that when the slide member 4 is in the second catch position, the cutting contacts 9 of the terminal 3 extend completely across the transverse bore 25 and terminate in corresponding recesses 10 contained in the wall of the transverse bore 25, thereby cutting the insulation of the first connector 5 to electrically engage the conductor 5*a*. During this axial shifting of the slide member 4, the electrical terminal 3 is maintained in place owing to the cooperation between the stop shoulders 21 on the connector body 3 and the adjacent end portions of the contacts 9. When the slide member 4 is in the second catch position shown in FIG. 2, the catch projection 6 extends within a second catch opening 8 contained in the connector body 2. During the insertion of the slide member 4 into the chamber 2*a* of the connector body, the conductor 5 is engaged by the shoulders 22 and 23 on the slide member 4 and the connector body 2, respectively to bend the conductor 5 orthogonally to the position 5' contained in a longitudinal slot 52 that is contained in the upper surface of the slide member 4. If desired, the conductor may again be bent orthogonally about the edge 22*b* of the connector body 2 toward the upwardly extending position shown by reference character 5 in FIG. 2.

The connector body is provided with at least one projection 14 for connecting the multi-pole body with other multi-pole connector bodies, or with other components of the system.

It should be noted that the catch projection 19 on the slide member 4 is resilient, and the end extremity 27 thereof extends outwardly beyond the corresponding end of the connector body when the slide member 4 is in the second catch position illustrated in FIG. 2. The stop shoulder 17 provided on the interior of the connector body 2 limits the extent of travel of the slide member beyond the second latch position of FIG. 2.

The diameter of thee transverse bore 25 corresponds generally with the outer diameter of the insulated first conductor 5 the chamfered ends of the extremities of the cutting contacts 9 being sufficiently withdrawn when the slide member is in the FIG. 1 position to permit insertion or the end of the first conductor into the bore 25. Similarly, the widths of the slot 28 is sufficient to permit insertion of the first cable 5 therethrough. The opposing wall portion 3 of the connector body limits the extent of insertion of the first conductor 5 then the transverse for 25. Of course, if the portion 23 of the connector body were to be removed, the insulated conductor 5 could be inserted completely through the transverse bore and through the connector body 4, thereby to loop through the connector body. The conductor 5 is locked to the connector body by the retaining shoulder 22*a* when the conductor is in the longitudinal position indicated by the reference numeral 5' in FIG. 2, and the two locking shoulders 22*a* and 22*b* serve to lock the conductor 5 to the connector body when the conductor 5 is bent to the orthogonally arranged position illustrated by the reference numeral 5.

Figure 3A:
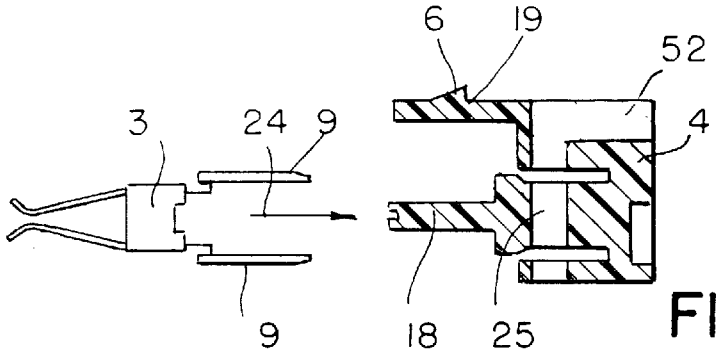
FIGS. 3*a*–3*c* are diagrammatic illustrations of one assembly procedure for assembling the electrical connector of FIG. 1.
Figure 3B:
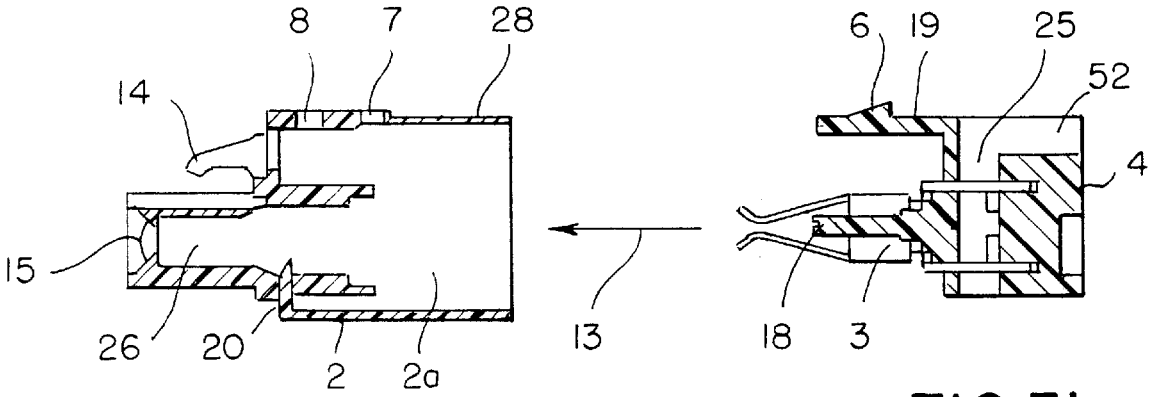
Figure 3C:
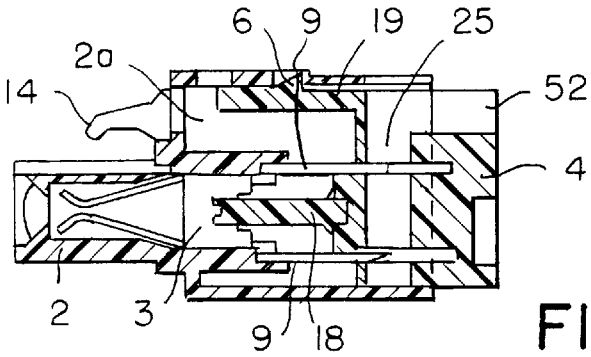

Referring now to FIGS. 3*a*–3*c*, a first assembly method is shown wherein the electrical terminal 3 is connected with the slide member 4 prior to insertion of the slide member 4 within the corresponding chamber 2*a* contained in the connector body 2. Thus, the connecting pin 18 of the slide member 4 is introduced within the opening contained in the transverse wall 3*a* (FIGS. 1 and 2). prior to insertion within the chamber 2*a*. Preferably, the terminal 3 is positioned on the pin 18 as shown in FIG. 1, whereby when the slide member is inserted to the first catch position of FIG. 1, the terminal 3 is abutted by the internal stop shoulders 21 on the connector body, and the tips of the cutting contacts 9 are withdrawn from the bore 25 to permit insertion of the first conductor 5 therein.

According to a particular advantage of the invention, slide members of different sizes may be interchanged within the chambers contained in the connector body 2 in accordance with the diameters of the first conductors 5, 105, and 205 (FIG. 6) that are to be connected with the second conductors 50, 150, and 250, respectively. Thus, the plug-in connectors of each subassembly can be assembled separately and be interchangeable as desired.

Figure 4A:
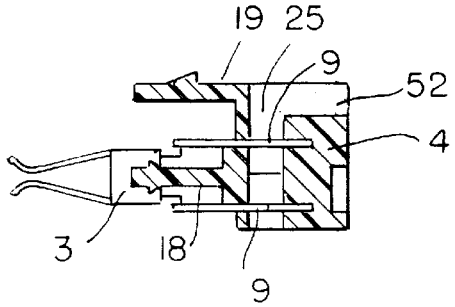
FIGS. 4*a*–4*d* are diagrammatic illustrations of another assembly procedure for assembling the electrical connector of FIG. 1.
Figure 4B:
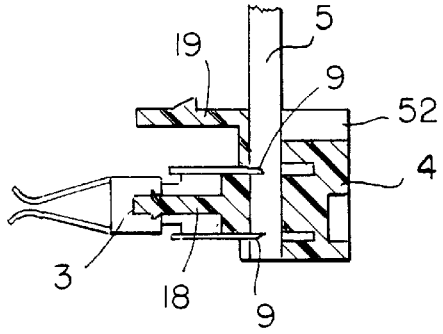
Figure 4C:
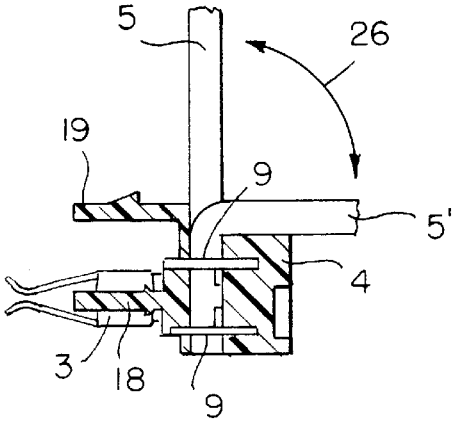
Figure 4D:
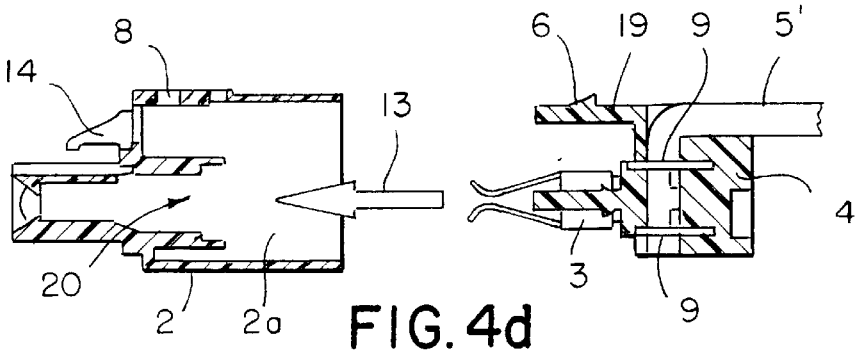

According to another advantage of the invention illustrated in FIGS. 4*a*–4*d* it is possible to connect the first conductor 5 with the slide number 4 prior to insertion of the slide assembly 4 within the chamber 2*a*. Thus, the terminal 3 is initially mounted on the pin 18 as shown in FIG. 4*a*, the conductor 5 is inserted in the bore 25 as shown in FIG. 4*b*, the terminal 3 is shifted to the right (for example, by suitable pliers means) to cause the cutting edges 9 to extend completely across the bore 25, and to cut the insulation of the conductor and come into an electrical engagement therewith. The conductor 5, if desired, may be bent to the position shown in FIG. 4*c* and identified by the reference numeral 5'. In this manner, reliable connection between the terminal and the slide member and between the slide member and the connector body is achieved. This preassembly of the conductor 5 with the associated slide member 4 offers the considerable advantage that the cables can be prefabricated precisely at the place where they are to be used and can, for example, be arranged on a plug-in connector on a cable tree in advance of the preassembly subassembly. As a result, the prefabrication assembly of a single conductor 5 may be achieved while avoiding the incorrect joinder of contacts.

Figure 5A:
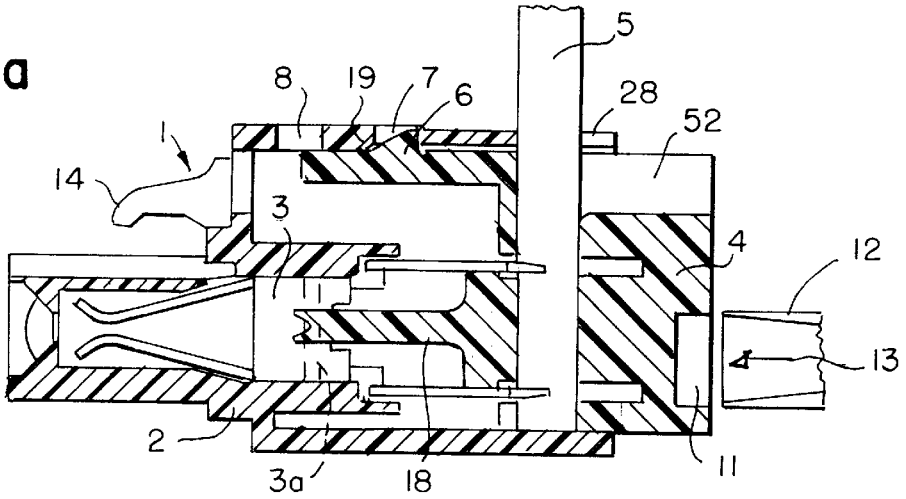
FIGS. 5*a* and 5*b* illustrate the assembly and disassembly procedures for the apparatus of FIGS. 1 and 2.
Figure 5B:
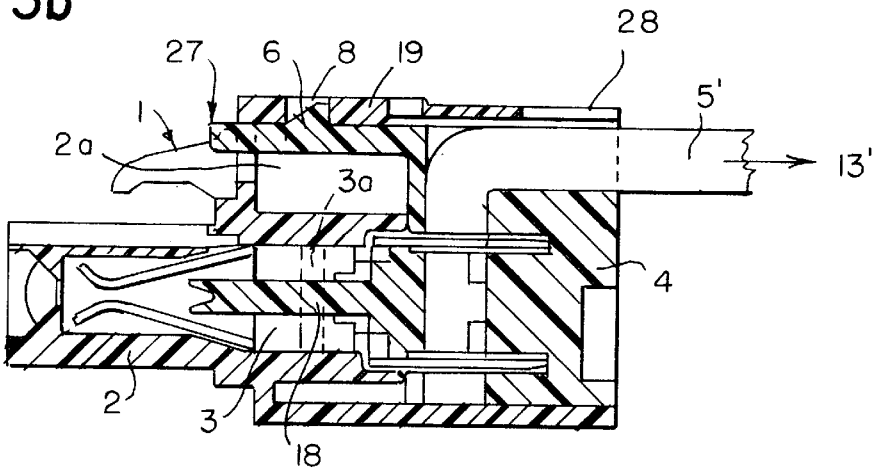

Referring now to FIGS. 5*a* and 5*b*, when it is desired to disassemble the slide member 4 and the conductor 5, one need merely apply pressure to the protruding extremity 27 of the resilient catch projection 19 to disengage catch member 6 from the corresponding catch opening 8, whereupon the slide member 4 may be shifted to the right to the initial catch position of FIG. 5*a*. The withdrawn slide member and conductor 5 may then be replaced with a similar slide member having a conductor of different size. Preferably, the slide members are color coded to effect the desired assembly of the components.

In conclusion, it is possible by means by suitable pliers type tools to displace the terminal 3 relative to the slide body 4 to effect cutting of the insulation by the projecting cutting context 9, thereby to come into electrical contact with the conductor contained within the insulation.

At the same time, depending on the type of magazine storage, the components and connection of assemblies may be supplied at such an orderly fashion as to be removed, for example by separation or by sheering. Correspondingly in addition to assembly pliers intended for use in assembling components, it is possible to effect assembly by semiautomatic and fully automatic assembly units, whereby the subassemblies 3 and 4 are automatically introduced within the multi-pole connector body. It is possible to achieve this assembly by means of prefabricated cable trees or the like in an automatic manner.

It should be mentioned that the connection subassemblies include slide bodies that correspond with the size of the first conductors 5, 105, and 205, and interchangability of the components and the wires is accordingly achieved, particularly, when the side members are color coded to permit a desired assembly of the elements.

While in accordance with the provisions of the Patent Statutes, the preferred forms and embodiments of the invention have been illustrated and described, they will be apparent to those skilled in the art that changes and modifications may be made without deviating from the inventive concepts set forth above.

What is claimed is:

1. An electrical plug-in connector (1) for connecting at least one first conductor (5) with a second conductor (50), comprising:

(a) a connector body (2) having a first end portion containing at least one chamber (2*a*), and a second end portion containing a through bore (2*b*) having a conductor insertion opening (15) communicating with said chamber;

(b) a slide member (4) having a first end portion including a longitudinally extending guide pin (18), said slide member containing a transverse bore (25) for receiving the first conductor (5), said connector body and said slide member being formed of an electrically insulating material; and (c) an electrical terminal (3) slidably mounted on said guide pin, said terminal having at one end at least one longitudinal first contact (9) adapted to extend orthogonally within said transverse bore via a corresponding opening contained in said slide member, said terminal including at its other end longitudinally extending female plug-in contact means (16);

(d) said slide member and said electrical terminal being relatively slidably displaceable between a first position in which said transverse bore is unobstructed by said first contact, thereby to permit insertion of the first conductor within said transverse bore, and a second position in which said first contact extends across said transverse bore in lateral electrical engagement with the first conductor and terminates in a corresponding recess (10) contained in the opposite wall portion of said transverse bore;

(e) said slide member and said electrical terminal being insertable as a unit within said connector body chamber to a position in which said electrical terminal plug-in contact means extends longitudinally within said through bore (2*b*) opposite said insertion opening.

2. An electrical connector as defined in claim 1, wherein said first conductor is insulated, and further wherein said first terminal contact is self-tapping and includes a cutting edge for cutting through the conductor insulation, thereby to engage electrically said first conductor.

3. An electrical connector as defined in claim 2, wherein said first contact extends generally normal to said transverse bore and to said first conductor.

4. An electrical connector as defined in claim 1, wherein said slide member and said conductor body include first catch means (6,7) for retaining said slide member in said first position relative to said connector body.

5. An electrical connector as defined in claim 4, and further including second catch means (6,8) for retaining said slide member in said second position relative to said connector body.

6. An electrical connector as defined in claim 1, wherein said slide member and said conductor body include first catch means (6,7) for retaining said slide member in said first position relative to said connector body.

7. An electrical connector as defined in claim 6, and further including second stop shoulder means (17) for limiting movement of said slide member beyond said second position.

8. An electrical connector as defined in claim 1, wherein said electrical terminal and said slide member are subsequently introduced as a unit within said connector body chamber.

9. An electrical connector as defined in claim 5, and further including means (27) for releasing said second catch means, thereby to permit displacement of said slide member in the direction from said second portion toward said first position.

10. An electrical connector as defined in claim 1, wherein said connector body first end contains a plurality of like chambers (21, 102*a*, 202*a*, 302*a*), said slide member being color coded for identification purposes.

11. An electrical connector as defined in claim 10, and further including a plurality of slide members (4, 104, 204) slidably arranged in said chambers, respectively and a plurality of terminals associated with said slide members, respectively the sizes of the terminals and of the transverse bores corresponding with the cross-sectional sizes of the associated first conductors, respectively.

12. An electrical connector as defined in claim 10, wherein at least one of said chambers contains a dummy plug means (D).

13. An electrical connector as defined in claim 1, wherein said slide member contains on its outer periphery an external groove (52) extending longitudinally from said transverse bore for receiving an orthogonally bent portion (5') of said conductor.

14. An electrical connector as defined in claim 1, wherein said connector body contains a slot (28) for receiving the first conductor when said slide member is in said first position relative to said connector body.

15. An electrical connector as defined in claim 1, wherein said slide member and said connector body each include retaining shoulder means (22) for retaining the first conductor in connected engagement with said connector body.

16. An electrical connector as defined in claim 1, wherein said connector body includes at least one projecting connector (14) for connecting the connector body with an adjacent assembly component.

* * * * *